United States Patent [19]

Watts

[11] 4,352,213

[45] Oct. 5, 1982

[54] LINKAGE ADJUSTMENT ARRANGEMENT FOR A BATHTUB DRAIN ASSEMBLY

[76] Inventor: Robert R. Watts, Rte. 2, Box 153, Blue Springs, Mo. 64015

[21] Appl. No.: 205,002

[22] Filed: Nov. 7, 1980

[51] Int. Cl.[3] ..... E03C 1/232

[52] U.S. Cl. ..... 4/199

[58] Field of Search ..... 4/191, 198, 199, 200, 4/201–203, 204–206, DIG. 7, 538, 546, 584, 661; 33/180 R, 169 B; 285/93; 116/277, DIG. 21

[56] References Cited

U.S. PATENT DOCUMENTS

| | | | |
|---|---|---|---|
| 1,901,118 | 3/1933 | Pope | 4/199 |
| 2,604,701 | 7/1952 | Joynes | 33/169 B |
| 2,646,767 | 7/1953 | Hanson | 116/277 |
| 3,656,188 | 4/1972 | Thorp | 4/199 |
| 3,835,484 | 9/1974 | Kato | 4/199 |
| 3,860,977 | 1/1975 | Politz | 4/199 |
| 3,870,067 | 3/1975 | Janiszewski | 4/201 X |
| 4,194,252 | 3/1980 | Tsuei | 4/199 |

FOREIGN PATENT DOCUMENTS

| | | | |
|---|---|---|---|
| 44726 | 10/1888 | Fed. Rep. of Germany | 285/93 |
| 795432 | 1/1936 | France | 4/199 |
| 890305 | 2/1944 | France | 4/199 |
| 651887 | 1/1963 | Italy | 285/93 |

*Primary Examiner*—Charles E. Phillips

*Attorney, Agent, or Firm*—Kokjer, Kircher, Bradley, Wharton, Bowman & Johnson

[57] ABSTRACT

In a bath waste and overflow arrangement, a system and method for easily and accurately adjusting a valve actuating linkage to the proper length. An adjustable overflow tube assembly is provided with a graduated scale that indicates the length to which the tube assembly is adjusted. The linkage has a similar scale and is adjusted in its length until such scale provides an indication corresponding to that on the first scale. This correspondence between the indicators on the scales assures that when the linkage is inserted into the overflow tube, its length is proper to accurately locate a valve plug controlled by the linkage.

4 Claims, 3 Drawing Figures

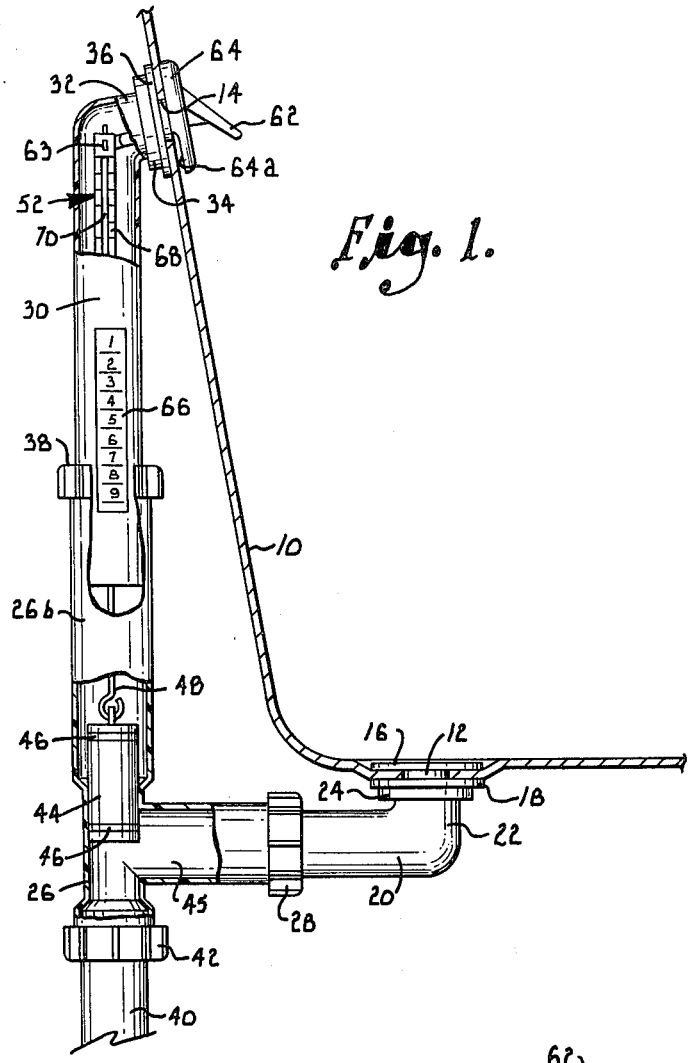
Fig. 1.
Fig. 3.
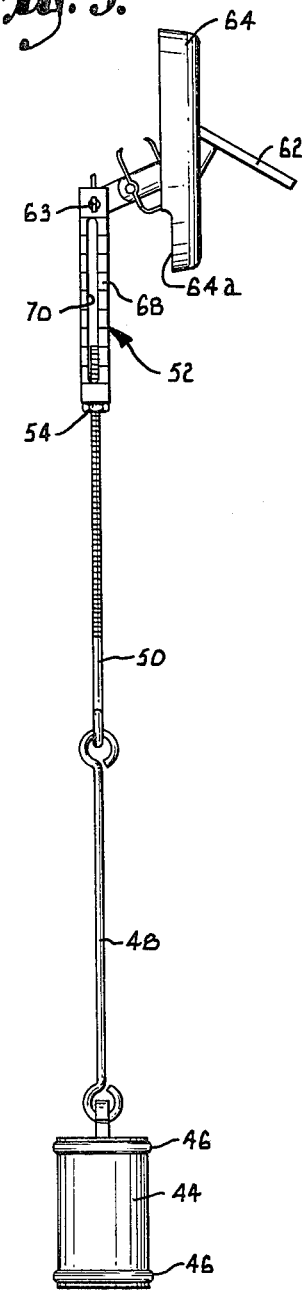
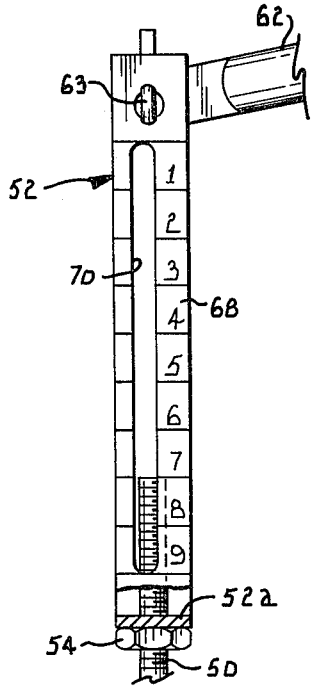
Fig. 2.

LINKAGE ADJUSTMENT ARRANGEMENT FOR A BATHTUB DRAIN ASSEMBLY

BACKGROUND AND SUMMARY OF THE INVENTION

This invention relates in general to drain and overflow systems for bathtubs and is directed more particularly to an improved linkage adjustment means and to a simplified method of installation.

The most widely used mechanism for controlling the drainage from a bathtub is a device known as a trip lever bath waste and overflow. Included in this product is a drain tube which leads from the tub drain and connects to a tee fitting. A vertical overflow tube extends downwardly from the elevated overflow port of the tub and connects to the upper end of the tee. A hollow cylinder known as a drop cylinder serves as a valve to control drainage from the tub and is located within the vertical portion of the tee. An adjustable linkage, usually consisting of two connected brass rods and a brass clevis connects the drop cylinder to a trip lever mechanism located at the tub overflow port. Moving the trip lever arm up or down closes or opens the tee to tub drainage.

Since the vertical distance from the overflow port to the drain port varies considerably among the various styles and brands of tubs, the overflow tube fits into the tee in a telescoping manner so that it can be raised or lowered as needed for proper installation. This requires that the linkage length also be adjustable. If the linkage is too short, the drop cylinder cannot seat inside the tee and close off the tube drainage. If the linkage is too long, the drop cylinder cannot clear the port inside the tee through which the tub drainage passes and may reduce the drainage rate.

Adjusting the linkage length normally is accomplished by threading the upper brass rod through an internally threaded hole in the bottom of the clevis. Threading the brass rod up or down through the hole in the clevis changes the overall linkage length as needed. A brass nut is then tightened securely against the bottom of the clevis to keep the length from changing.

It is important to recognize that there is no universally accepted method of determining proper linkage length. Some manufacturers of bath wastes simply leave it to the plumber to figure out the proper length. Those manufacturers that do include linkge adjustment instructions with each bath waste tend to have their own method depending upon their particular design. Probably the most common method is to rest the drop cylinder on the bottom of the tub and then visually align some portion of the upper linkage with some portion of the overflow port of perhaps the retainer plate which holds the overflow ell securely to the overflow port. This procedure is subject to several possible errors.

First, with the drop cylinder resting on the tub bottom, the linkage length can be altered at least 3/16" due to the flexible connection between the two brass rods. Second, many tubs are not level at the drain port, and this can lead to inaccuracy. Third, holding the linkage assembly upright so that it is fully extended, yet making sure that the drop cylinder remains in contact with the tub bottom is a difficult procedure which is subject to error. Fourth, visual horizontal alignment of two parts below the top edge of the tub is not always accurate.

Fifth, some plumbers rely on memory as to the various alignment methods used.

If the linkage length is not correct, the linkage assembly must be removed, the length must be changed, the linkage must be reinstalled and it must then be retested. If adequate testing is not accomplished when the tub is installed, the plunger may have to make a special trip to adjust the linkage. For an increasing number of plumbing contractors, the labor costs associated with readjusting the linkage length on trip lever bath wastes have become so great that they are now using a more expensive bath waste that does not contain a linkage of any kind.

It is thus apparent that a need exists for a method of quickly and accurately adjusting the overall linkage length in a trip lever bath waste in a manner that is quick, accurate, and easy to understand and remember. The primary goal of the present invention is to meet that need.

More specifically, it is an object of the invention to provide, in a trip lever bath waste and overflow assembly, a linkage adjustment system and a method that avoids reliance on visual alignment. The human error that inevitably results from attempts at visual alignment is thus elminated.

Another object of the invention is to provide a linkage adjustment system and method in which adjustment of the linkage can be carried out quickly and with a minimal difficulty.

A further object of the invention is to provide a linkage adjustment system and method wherein the procedure to be followed is easily understood and remembered.

An additional object of the invention is to provide a linkage adjustment system and method that are well adapted to be used with a wide variety of of linkage designs.

Other and further objects of the invention, together with the features of novelty appurtenant thereto, will appear in the course of the following description.

DETAILED DESCRIPTION OF THE INVENTION

In the accompanying drawings which forms a part of the specification and are to be read in conjunction therewith and in which like reference numerals are used to indicate like parts in the various views:

FIG. 1 is a fragmentary side elevational view of a trip lever bath waste and overflow drain system which is equipped with a linkage adjustment arrangement constructed in accordance with the present invention, and with portions broken away for purposes of illustration;

FIG. 2 is an enlarged, fragmentary, elevational view of the clevis which forms part of the valve actuating linkage; and FIG. 3 is a side elevational view of the valve actuating linkage.

Referring initially to FIG. 1, numeral 10 designates a bathtub having the usual drain port 12 in its bottom surface and an overflow port 14 in one end wall. The drain and overflow system for the tub includes a strainer assembly having a strainer body 16 which extends through the drain port 12 and is covered by a conventional strainer plate (not shown). A washer 18 is fitted around the lower portion of the strainer body and positioned against the underside of the tub bottom. A drain tube 20 has a vertical ell portion 22 into which the strainer body is threaded, with a flange on the top end of ell 22 compressing washer 18. A tee fitting 26 has a horizontal portion 26*a* which receives the end of drain tube 20 in a telescoping manner. A nut 28 is used to secure the drain tube to the tee fitting.

The top end of the vertical portion 26*b* of tee fitting 26 receives an overflow tube 30 having an overflow ell 32 on its top end. Together, the tee fitting 26 and overflow tube 30 make up what is referred to herein as an overflow tube assembly. The overflow ell 32 is secured against the outer surface of the end wall of the tub and has a flange 34 which compresses a washer 36 against the tub wall around the overflow port 14. The lower end of tube 30 fits into the upper end of tee fitting 26 in a telescoping manner and is secured in position by a nut 38 which is threaded onto the top of the tee fitting. A tail piece 40 is connected with the lower end of fitting 26 by a nut 42. The tail piece leads to a drainage trap (not shown).

The drainage of wastewater from the tub is controlled by a hollow cylindrical drop valve 44 which is located within the vertical portion of tee fitting 26 adjacent a port 45 formed at the intersection between the horizontal and vertical portions 26*a* and 26*b* of the fitting. Drop valve 44 carries a pair of seal rings 46 near its top and bottom ends to seal off port 45 when the plug is moved downwardly to its closed position. In the closed position, the lower seal ring 46 seals against the inside wall of fitting 26 at a location below port 45, while the upperseal ring forms a seal above port 45.

As best shown in FIG. 3, the drop valve 44 is carried on and controlled by an actuating linkage that includes a brass rod 48. Rod 48 is hooked at its lower end to drop valve 44 and at its upper end to the bottom end of a eye bolt 50. Eye bolt 50 is provided with threads on its upper end and is threaded through the bottom portion 52*a* (FIG. 2) of a clevis 52. The clevis has opposite sides and an open interior region into which the upper threaded end of eye bolt 50 projects. Eye bolt 50 is secured in position relative to the clevis by a nut 54 which can be loosened to permit the eye bolt to be threaded into or out of the clevis.

The top portion of clevis 52 is pinned to one end of lever arm 62 by a cotter pin 63. Trip lever 62 is mounted on a circular overflow plate 64. When the unit is assembled, the overflow plate 64 is screwed to or otherwise attached to the overflow ell 32 at a location adjacent overflow port 14. The overflow plate 64 is provided with an opening 64*a* on its lower portion which communicates with the overflow port 14 of the tub. The trip lever 62 can be pivoted downwardly such that the linkage raises plug 44 to the open position wherein port 45 is exposed. In this position, waste water from the tub can flow into the tail piece 40 from the drain ell 22, the drain tube 20 and the tee fitting 26. When the trip lever is pivoted upwardly, plug 44 is dropped to the closed position wherein port 45 is closed to permit the tub to be filled with water.

As thus far described, the bath waste and overflow system and the valve linkage are constructed conventionally. In accordance with the present invention, the outer surface of overflow tube 30 is provided with a vertical scale 66 having a series of equally spaced graduation marks which are each associated with a numeral. An indication is provided on the scale by the top surface of the slip nut 38 which generally coincides with the upper edge of tee fitting 26. The scale 66 is arranged such that the indication provided on it provides a measure of the distance between the overflow port 14 and port 45 of the tee fitting, which distance corresponds to the effective length of the overflow tube assembly.

One of the sides of clevis 52 is likewise provided with a vertical scale 68 having spaced apart graduation marks and associated reference numerals. The clevis side has a vertical slot 70 extending the length of scale 68, and the top end of eye bolt 50 is visible through slot 70 so that it can provide an indication on scale 68. The scales 66 and 68 are arranged and located relative to one another such that when the indications provided on the scales correspond, the drop valve 44 will be properly located relative to port 45 to effectively open and close the bathtub drain.

The drain and overflow system is installed on the bathtub by first inserting the strainer body 16 through the drain port 12 and threading it into the drain ell 22. The horizontal portion 26*a* of tee fitting 26 is then telescoped onto drain tube 20, and the overflow tube 30 is telescoped into the upper end portion of the tee fitting and is adjusted until the overflow ell 32 is located properly relative to the overflow port 14. When the length of the overflow tube assembly has been properly adjusted, nuts 28 and 38 are tightened and the overflow ell is secured to the end wall of the tub.

The present invention provides a fast, convenient, accurate and easy to remember system for properly adjusting the length of the valve actuating linkage prior to inserting the valve and linkage into the overflow tube assembly. In accordance with the invention, the indication provided on scale 66 by the top surface of nut 38 is noted once the overflow tub assembly has been adjusted to the proper length. Eye bolt 50 is adjusted by threading it into or out of clevis 52 until the indication provided on scale 68 by the top end of the eye bolt corresponds with the indication provided on scale 66. For example, when the overflow tube assembly is adjusted to the proper length for the bathtub shown in FIG. 1, the upper surface of nut 38 is aligned with the graduation mark associated with the numeral "7" on scale 66. Eye bolt 50 is threaded into clevis 52 until the top end of the eye bolt is aligned with the graduation mark associated with the numeral "7" on scale 68. Nut 54 is then tightened against the bottom surface of the clevis to secure the eye bolt in position.

Once the length of the linkage has been adjusted in the manner indicated, drop valve 44 and the linkage are inserted through overflow port 14 and into tube 30 and the vertical portion 26*b* of T-fitting 26. Overflow plate 64 is then secured by screws or the like (not shown) to the overflow ell.

Due to the present locations of scales 66 and 68, this method of installation assures that drop valve 44 will be located properly to open and close the bathtub drain when the trip lever 62 is pushed downwardly or pulled upwardly. It should be pointed out that bathtubs vary in the vertical distance between the drain port and overflow port, and that the length of the overflow tube assembly (overflow tube 30 and the vertical portion of T-fitting 26) can be adjusted to accommodate such variations. Corresponding adjustment of the length of the linkage can be quickly and accurately carried out simply by aligning the top end of eye bolt 50 with the graduation mark on scale 68 which corresponds with the graduation mark on scale 66 that is aligned with the upper surface of nut 38 once the overflow tube assembly has been properly adjusted. There is no reliance on visual alignment since the indicators (the upper surface of nut 38 and the upper end of eye bolt 50) are located immediately adjacent to the scales, and the possibility of human error virtually eliminated. At the same time, the linkage adjustment system and method are easily understood and remembered and are readily adapted for different types of linkages, including linkages having a portion thereof extending within drain tube 20 to connection with a stopper located adjacent the drain opening 12 of the tub. It is to be understood that the scales can be located on various portions of the overflow tube assembly and the linkage, and that various types of indicators can be used to provide indications on the numerical scales.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A method of assembling a bathtub drain system having an adjustable overflow tube assembly which includes a pair of tubes interfitting in a telescoping manner, a valve for controlling flow through a drain of the bathtub, and an actuator linkage for the valve including a pair of link members which are adjustable to adjust the length of the linkage, said method comprising the steps of:

providing a first scale on one of the tubes at a location to cooperate with an indicator portion of the other tube to present on the first scale an indication of the combined effective length of the tubes;

providing a second scale on one of the link members at a location to cooperate with an indicator portion of the other link member to present on the second scale an indication of the length of the linkage, said scales being arranged and related such that when the indications presented on the first and second scales correspond, the combined effective length of the tubes corresponds with the length of the linkage to properly position the valve for controlling flow through the drain;

applying the tubes to the bathtub with said tubes adjusted to a predetermined combined effective length for fitting the bathtub;

adjusting the length of the linkage to effect correspondence of the indication presented on the second scale with the indication presented on the first scale; and inserting the linkage and valve into the overflow tube assembly, thereby properly positioning the valve for controlling flow through the drain.

2. In a bathtub drain arrangement for a bathtub having a drain opening and an overflow opening, the improvement comprising:

a drain pipe adapted for connection with the drain opening;

a pair of telescoping tubes adapted to extend generally vertically between the overflow opening and drain pipe, said tubes interfitting in a telescoping manner to permit variation of the combined effective length thereof to accommodate variations in the distance between the drain and overflow openings;

a scale on one of said tubes cooperating with an indicator portion of the other tube to provide an indication of the combined effective length of said tubes;

a valve for controlling drainage through the drain opening;

a linkage for controlling the position of the valve, said linkage including a pair of links adapted to extend within said tubes, said links interfitting in a threaded manner to permit variation in the length of said linkage to accommodate variations in the combined effective length of said tubes;

a trip lever for actuating said linkage to adjust the position of said valve; and a scale on one of said links cooperating with an indicator portion of the other link to provide an indication of the length of said linkage, thereby permitting adjustment of said links until the indications on said scales correspond to effect the linkage length required to properly position said valve for control of the drainage through the drain opening.

3. The improvement set forth in claim 2, wherein said one link is formed by a clevis and said other link is formed by a rod threaded into said clevis and having a top end located adjacent the scale on said clevis to provide the indicator portion of said other link.

4. The improvement set forth in claim 2, including a tee fitting having a generally vertical portion providing said other tube and a generally horizontal portion connected with the drain pipe, said vertical portion of the tee fitting having a top end providing said indicator portion of said other tube.

* * * * *